United States Patent [19]

Thompson

[11] Patent Number: 4,723,703

[45] Date of Patent: Feb. 9, 1988

[54] OVER-RIDE CIRCUIT

[75] Inventor: Kevin D. Thompson, Indianapolis, Ind.

[73] Assignee: Carrier Corporation, Syracuse, N.Y.

[21] Appl. No.: 942,734

[22] Filed: Dec. 17, 1986

[51] Int. Cl.[4] ..... F23N 1/00

[52] U.S. Cl. ..... 236/11; 236/94; 431/20

[58] Field of Search ..... 236/11, 10, 94; 62/213, 62/161, 163; 364/187; 431/20, 89

[56] References Cited

U.S. PATENT DOCUMENTS

| | | | |
|---|---|---|---|
| 2,322,714 | 6/1943 | Kalischer | 62/163 |
| 4,299,555 | 11/1981 | Kamberg | 431/20 |
| 4,421,268 | 12/1983 | Bassett et al. | 236/10 |

OTHER PUBLICATIONS

Hendrie et al, *Control Engineering,* "Reliability Still Means Backup" pp. 131–135, Sep. 1966.

*Primary Examiner*—Harry Tanner
*Attorney, Agent, or Firm*—Dana F. Bigelow

[57] ABSTRACT

An emergency heat bypass arrangement for a furnace in which the normal controller path is supplemented by an alternate path through a relay subject to an emergency heat switch controlling the solenoid of the relay, and the relay includes additional contacts for keeping power on the solenoid even after the furnace high pressure switch changes contacts to provide heating when said controller has malfunctioned.

13 Claims, 3 Drawing Figures

OVER-RIDE CIRCUIT

BACKGROUND OF THE INVENTION

The technical field herein is that of furnace controls and particularly that of furnace control over-ride circuits effective to bypass the furnace controls if a need for emergency heat arises.

As is well known, furnaces in current use generally operate under the close direction of a controller, which in modern times is frequently microprocessor based or driven. Such a controller fails from time to time whether microprocessor driven or not, often just when the need for heat from the furnace is particularly urgent. Accordingly, at such times there is a clear need to bypass or over-ride the furnace control arrangement to enable the furnace to be operated without interference from the currently non-operable controller.

SUMMARY OF THE INVENTION

According to the invention herein, a furnace over-ride circuit can be constructed to include an emergency heat relay (EHR), such as for example a DPST relay, an emergency heat switch (EHS), such as for example a SPST switch, a four-diode motor control signal isolation arrangement for isolating the motor control signals from the ignition relay (IR), and a high fire pressure switch (HFPS). The four-diode arrangement is connected in parallel with the on-off line for the furnace blower, a blower pulse width line (BPWL) and an inducer pulse width line (IPWL). The anode of a selected one of the diodes in the four-diode arrangement is connected to the ground side of the ignition relay coil. The arrangement is connected to enable the furnace inducer and blower motors to be microprocessor operated as variable speed motors, or to be operated in an emergency heat mode effective for running the motors at maximum speed when the normally open contacts on the emergency heat relay close and thus pull the control lines for the blower and inducer motors to ground. Thus, according to the invention, the furnace control system is bypassed to operate under emergency conditions with a furnace bypass arrangement, the control system having an ignition relay, including an ignition solenoid or coil, for providing ignition power to the furnace, a normally microprocessor controllable ground path through a ground path transistor having a control node, a ground node, and a ground path node for providing a DC ground path to said ignition solenoid or coil, a diode bridge means for converting AC power to DC power, said diode bridge means including an ignition solenoid node for connection to one side of said ignition coil, a DC ground node, an AC power node, the other side of the solenoid being connected to the ground path node, and the bypass arrangement comprising an alternate ground path connected to said ground path node for selectively grounding said ground path node independent of the operation of said normally controllable ground path means, whereby said ignition relay is independently actuable to conduct selected furnace operations, and the blower on/off and the blower and inducer pulse width control lines are pulled to ground to turn on the blower and inducer motors to operate at maximum speed. Further, according to the invention, the alternate ground path means includes a relay for selectively grounding the ground path node, and the relay includes first and second sets of relay contacts as well as a coil or solenoid effective for permitting selective opening and closing of the first set of relay contacts to accomplish selective grounding of the ground path node. The bypass arrangement further including an emergency heat switch for selectively opening and closing the relay contacts, and according to the scheme of the invention, the emergency heat switch is in series with said coil or solenoid. The control switch additionally includes a high pressure switch, which is set in a closed state when the heat exchanger pressure drop is below a predetermined level and which opens when the threshold is exceeded, in order to apply AC power to the emergency heat switch when in the closed state. The second set of relay contacts is effective for providing power to the emergency heat switch after the high pressure switch normally closed contacts open, according to the invention. In particular, during emergency conditions, this power is directly applied to the relay coil or solenoid, effectively latching the contacts in a closed state and keeping power flowing through the solenoid. As a result, the solenoid is effective for closing both sets of relay contacts. According to the invention, the ground path arrangement further includes four diodes which are effective at directing current flow toward ground. The provision of the alternate ground path effectively enables the selective turning of the furnace blower on and off, and additionally enables the setting of the speed of the furnace blower, in particular, toward a predetermined maximum level, for example, according to a preferred version of the invention. Beyond this, the level of speed to the furnace inducer fan is also settable by provision of the alternate ground path, again as suggested immediately above to a predetermined maximum level, for example.

DESCRIPTION OF THE PREFERRED EMBODIMENT

Figure 1:
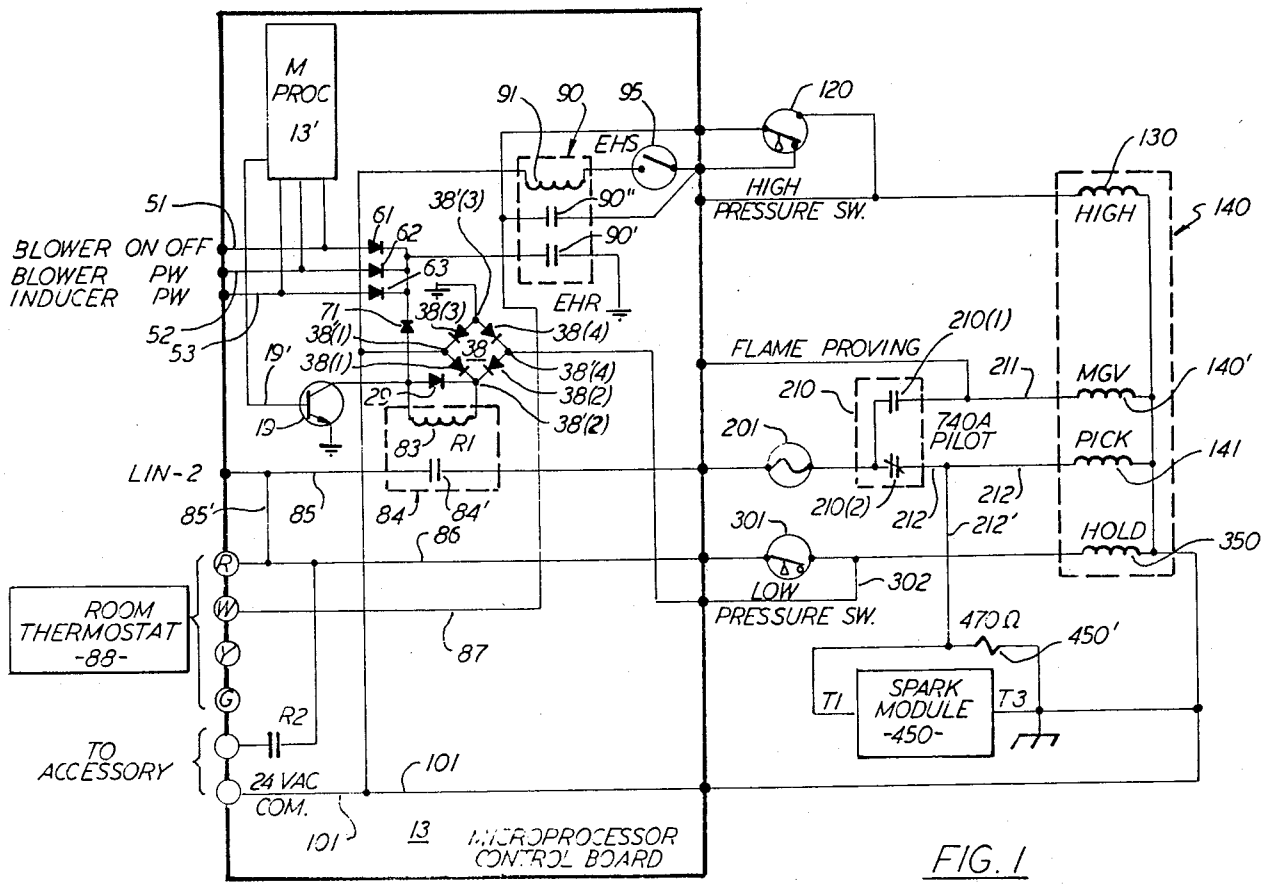
FIG. 1 is a circuit schematic showing the emergency heat arrangement according to the invention herein.

FIG. 1 shows a control board 13 for operation in a furnace control arrangement, in this case including a microprocessor 13' for governing normal operation in a non-emergency mode. The microprocessor 13' is shown connected to the base of a ground path control transistor 19 along line 19' to effect the grounding of the anodes of diodes 29 and 71, to be discussed more particularly below, during normal operation. Transistor 19 acts as a normally controllable ground path means, including a control node at the connection to line 19', a ground node at the emitter output, and a ground path node at the collector output.

The transistor 19 is emitter connected to ground while the collector thereof is connected to the anode of diode 29 which in turn leads to a four-diode arrangement 38 including diodes 38(1) through 38(4) and in particular to the cathodes of respective diodes 38(1) and 38(2) thereof. Diodes 38(3) and 38(4) in turn are connected at their respective anodes to DC ground, and at their cathodes respectively to the anodes of diodes 38(1) and 38(2). The respective diodes 38(1)–38(4) are interconnected at corresponding nodes 38'(1)–38'(4), these being respectively the AC ground node, the ignition solenoid node, the DC ground node, and the AC power node. The four diode arrangement 38 operates as a diode bridge means for converting AC to DC power.

Microprocessor 13' is additionally connected to respective blower on/off line 51, blower pulse width control line 52 and inducer pulse width control line 53, which respectively lead to the anodes of diodes 61, 62 and 63 which in turn are connected at their respective cathodes to the cathode of diode 71. The anode of diode 71 is connected to the collector of transistor 19. Further, diode 29 is shunted by ignition relay coil 83, which includes switch contacts 84' as part of a unitary ignition relay arrangement 84. One side of ignition relay switch 84' is connected to limit input line LIM-2, herein designated line 85 for convenience and additionally to room thermostat power connection "R" along line 85'. Connection of microprocessor 13' to respective leads 51–53 permits variable speed control while in the non-emergency mode.

Room thermostat connection "W" is in turn connected to the emergency heat relay 90 which includes switch contacts 90' and 90", and coil 91, respectively in parallel. Switch 90" is connected to normally open emergency heat switch 95, and is additionally connected between diodes 38(3) and 38(1), and to the 24 VAC common line 101 of microprocessor control board 13. Emergency heat switch 95 is additionally connected to off board high pressure switch 120 and then in turn to the high heat solenoid coil 130 of gas valve 140, as shown in FIG. 1.

Ignition relay coil 84 including contact 84' is further connected to fusible link 201 which in turn is connected to switch 210 including normally open contacts 210(1) and normally closed contacts 210(2) and having respective outputs 211 and 212 which are respectively connected to the main gas valve (MGV) coil 140' and to pick coil 141 of gas valve 140.

The nexus between the "R" connection of room thermostat is effected along line 86 through low pressure switch 301 to line 302 which connects to the cathode of diode 38(4) and the anode of diode 38(2) thereby supplying AC power to diode ring 38. The output of switch 301 additionally connects to the hold coil 350 of gas valve 140, with the outputs of coils 130, 140', 141 and 350 all being connected at their respective outputs to the 24 VAC common ground line 101 and to the connection T3 of ignition or spark module 450.

The spark module 450 input connection T1 is connected through preferably 470 ohm resistor 450 to chassis ground because of electrical noise generation. Additionally, connection T1 of spark module 450 is made to line 212 along line 212', to enable receipt of AC power to run furnace spark or ignition module 450.

Figure 2:
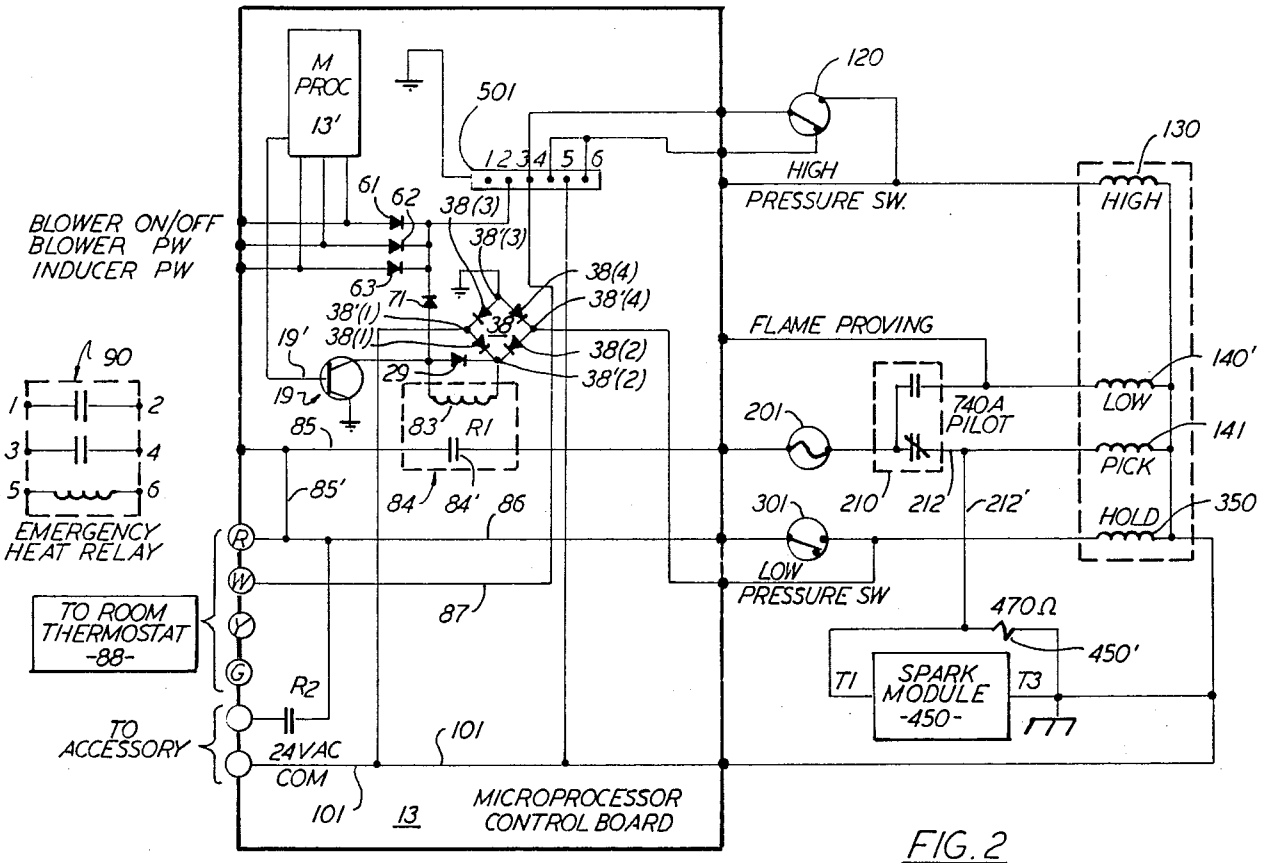
FIG. 2 is a circuit schematic showing an additional version of the emergency heat arrangement according to the invention herein, in which the emergency heat switch and relay are externally connectable to the furnace controller.

According to an additional version of the invention, as disclosed and displayed in the circuit schematic shown in FIG. 2, six-point connector 501 is employed to allow external connection to the emergency heat relay 90, whereby switch 95 can be eliminated through an electrical harness (not shown). Pin 1 thereof is connected to ground; the override connections are made through diodes 61, 62, 63 and 71 and pin 2 of emergency heat relay 90: the input side of switch 120 and additionally the "W" connection to the room thermostat 88 are connected to pin 3; the 24 VAC common line 101 is connected to pin 5 thereof; and the normally closed output side of switch 120 is connected to pin 4 and pin 6 thereof.

Figure 3:
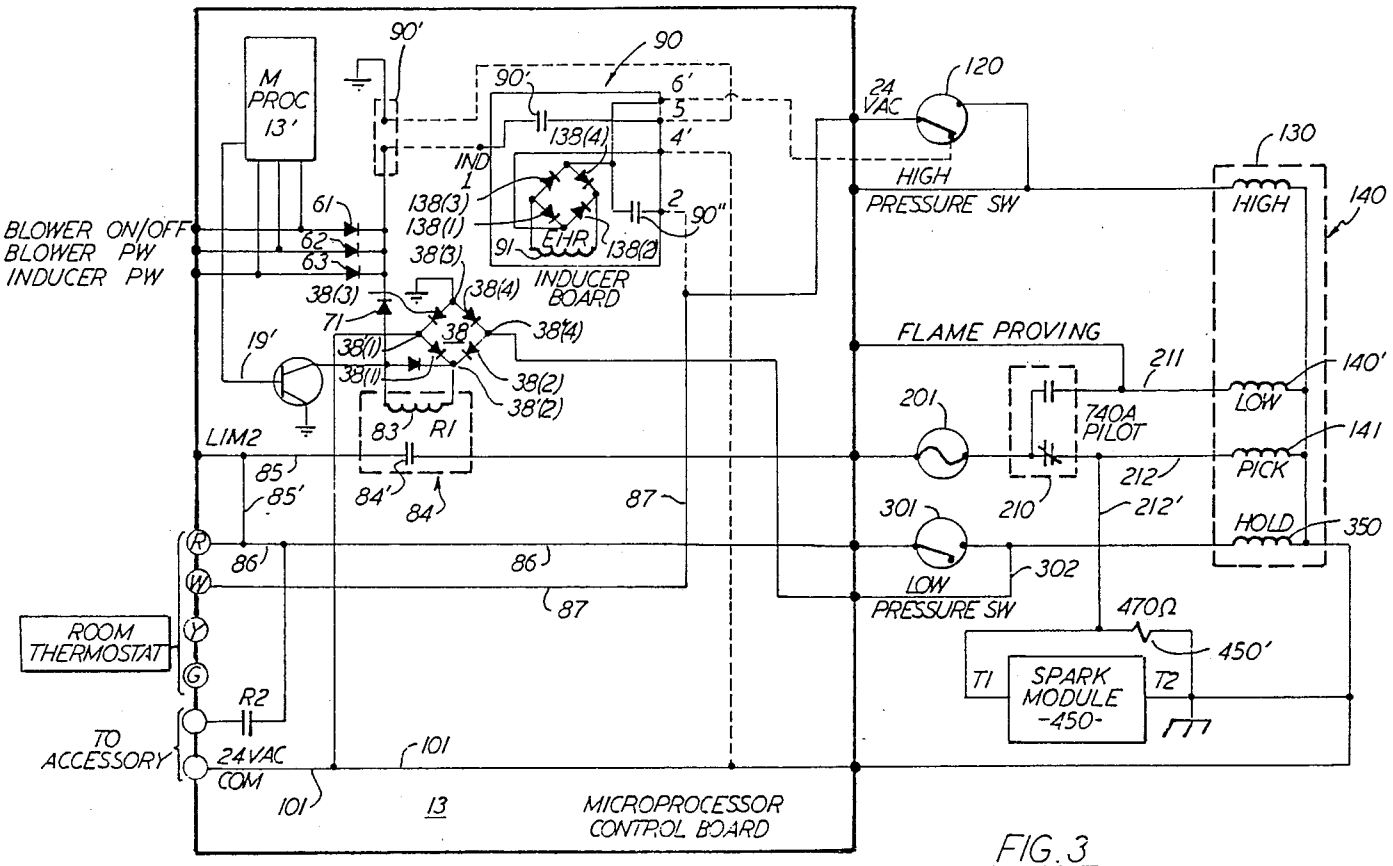
FIG. 3 shows yet another emergency heat arrangement according to the invention herein, which obviates the need for the emergency heat switch and employs a four-diode arrangement to drive the emergency heat relay directly.

According to even another version of the invention, FIG. 3 shows a standard inducer board 90 substituted for relay 90 of FIG. 1. Board 90 includes the same elements as relay 90, including solenoid 91 connected to AC power along node 6' through diode 138(4) and to common ground through node 4' and diode 138(1), switch contacts 90' are connected from the cathode of diode 71 to ground through pins 1 and 5 on FIG. 3. Finally, switch contacts 90" are connected to AC power, i.e. thermostat contact "W" along line 87 and pin 2 and then through coil 91 and diode 138(1) to AC common via pin 4'.

While this invention has been described with reference to a particular embodiment disclosed herein, it is not confined to the details set forth herein and this application is intended to cover any modifications or changes as may come within the scope of the invention.

What is claimed is:

1. An arrangement for bypassing a furnace control system to operate the furnace under emergency conditions, said control system comprising an ignition relay for providing ignition power to a furnace ignition ndule and to the furnace gas valve, said ignition relay including an ignition solenoid, said control system further comprising a normally controllable ground path means, including a control node, a ground node, and a ground path node, for providing a ground path to said ignition solenoid, diode bridge means for converting AC power to DC power, said diode bridge means including an ignition solenoid node, a DC ground node, an AC power node and an AC ground node, said ignition solenoid node being connected to one side of said ignition solenoid, and the other side of said solenoid being connected to said ground path node, said bypass arrangement comprising additional ground path means connected to said ground path node for selectively grounding said ground path node operation of said normally controllable ground path, whereby said ignition relay is independently actuable to conduct selected furnace operation.

2. The arrangement of claim 1, wherein said additional ground path means includes a relay for selectively grounding said ground path node.

3. The arrangement of claim 2, wherein said relay includes a first set of relay contacts and a solenoid effective for permitting selective opening and closing of said first set of relay contacts.

4. The arrangement of claim 3, wherein said bypass arrangement includes an emergency heat switch means, for selectively opening and closing the relay contacts.

5. The arrangement of claim 4, wherein said emergency heat switch means is in series with said solenoid.

6. The arrangement of claim 4, wherein said control system includes a high pressure switch means, set to a closed state when the furnace inducer pressure is below a predetermined level and which opens when said threshold is exceeded, for applying AC power to said emergency heat switch means while in the closed state.

7. The arrangement of claim 4, wherein said relay includes a second set of relay contacts for providing power to said emergency heat switch means.

8. The arrangement of claim 7, wherein said solenoid is effective for closing both sets of relay contacts.

9. The arrangement of claim 7, wherein said second set of relay contacts is effective for latching said relay into closed position, whereby power is maintained across said solenoid.

10. The arrangement of claim 1, wherein said alternate ground path means includes a diode effective for directing current flow toward ground.

11. The arrangement of claim 1, wherein said alternate ground path means is effective for turning the furnace blower on and off.

12. The arrangement of claim 1, wherein said alternate ground path means is effective for setting the level of speed to the furnace blower.

13. The arrangement of claim 1, wherein said additional ground path means is effective for setting the level of speed of the furnace inducer fan.

* * * * *